US006389612B1

(12) United States Patent
Harris

(10) Patent No.: US 6,389,612 B1
(45) Date of Patent: May 21, 2002

(54) PORTABLE TOILET SEAT

(76) Inventor: Essie Harris, 9241 S. Pleasant, Chicago, IL (US) 60620

( * ) Notice: Subject to any disclaimer, the term of this patent is extended or adjusted under 35 U.S.C. 154(b) by 0 days.

(21) Appl. No.: 09/663,954

(22) Filed: Sep. 19, 2000

(51) Int. Cl.[7] ..... A47K 13/06
(52) U.S. Cl. ..... 4/239
(58) Field of Search ..... 4/239

(56) References Cited

U.S. PATENT DOCUMENTS

| | | | | | |
|---|---|---|---|---|---|
| 168,402 | A | * | 10/1875 | Laumonier | 4/239 X |
| 2,454,199 | A | * | 11/1948 | Perrin | 4/239 |
| 2,517,755 | A | * | 8/1950 | Yumoto | 4/239 X |
| 2,649,270 | A | * | 8/1953 | Franks | 4/239 X |
| 3,588,927 | A | * | 6/1971 | Sprnger | 4/239 |
| 3,601,822 | A | | 8/1971 | Weiss | 4/234 |
| 4,516,279 | A | | 5/1985 | Block | 4/239 X |
| 5,090,063 | A | * | 2/1992 | Edwards et al. | 4/239 |
| 5,384,917 | A | | 1/1995 | Epling | 4/235 |
| 5,524,295 | A | | 6/1996 | Ford | 4/239 |
| 5,608,921 | A | | 3/1997 | Barrett et al. | 4/239 |
| 5,749,104 | A | | 5/1998 | Evans | 4/239 |
| 5,779,306 | A | | 7/1998 | Ohlsson | 297/256.16 |
| 5,797,148 | A | | 8/1998 | Kivela | 4/235 |
| 5,842,234 | A | | 12/1998 | Dixon | 4/235 |

* cited by examiner

*Primary Examiner*—Robert M. Fetsuga
(74) *Attorney, Agent, or Firm*—Barnes & Thornburg; Alice O. Martin

(57) ABSTRACT

A portable toilet seat for use with an existing toilet, including a toilet seat for covering the existing toilet, and a container for transporting the toilet seat, with the toilet seat being mounted within container.

19 Claims, 6 Drawing Sheets

PORTABLE TOILET SEAT

FIELD OF THE INVENTION

This invention relates to a portable toilet seat. In particular, the invention relates to a toilet seat that can be more safely and sanitarily used when placed upon a public restroom toilet seat, and can be conveniently and discretely transported.

BACKGROUND

The use of a public toilet by young children and physically or mentally challenged adults in some instances takes place in bathrooms with questionable sanitary conditions and safeguards. An adult caregiver in charge of these individuals can also face logistical problems in these circumstances, especially when it becomes necessary for the adult caregiver to aid the young children or adults in their care to use a public toilet. Often, the parent or primary caregiver must carry a means for covering the seat, which can be burdensome when traveling. In the instances where paper seat liners are available in public restrooms, the parent or primary caregiver (hereinafter referred to as "caregiver") has to adjust and re-adjust the paper liner. These adjustments can be difficult for the caregiver to make in the limited confines of a walled public toilet, especially when the caregiver must also safeguard/handle a toddler or developmentally or physically challenged adult.

In many instances, these paper liners are simply not available in the restroom, as is the case in many public restrooms, such as gas stations, highway rest areas, and restaurants. When the paper liner is not available, the parent or caregiver is frequently required to clean the seat prior to use to remove stains and bacterial growth. This can also be a difficult task when the caregiver is simultaneously trying to manage and safeguard the person under their care. The alternative for the caregiver is to seat the person upon the public toilet seat without cleaning the seat, and expose them to any contamination and debris that may have accumulated thereon.

Upon seating the person upon the toilet seat, the caregiver is then faced with the problem of keeping the person safely seated upon the toilet until completing the process of urination/defecation, and for follow-up cleaning. This process is hereinafter collectively referred to as using the toilet or "toileting". Often times, the person being cared for has a short attention span, limited experience on adult sized toilets, or possibly an out-right uncooperative nature, all of which can result in toileting accidents when placed upon a standard sized toilet seat in a public restroom.

In some situations, the caretaker must have the physical strength and stamina to hold the person in their care above or upon the toilet seat. This maneuver can also be difficult in the confines of a walled public toilet stall, and, if the caregiver's stamina is insufficient and their support waivers, this maneuver sometimes causes the person in their care to rush with toileting.

Also, if the person being cared for is a child of tender years, the seat itself may have an aperture too large to support the child comfortably, and the caregiver must then aid the child in staying centered above the seat. Again, in the confines of a walled public restroom, providing this aid can be difficult for the caregiver.

Some of the toddler toilet seats available today are removable, and can be placed upon a standard toilet seat. However, these removable seats do not provide a container or cover for transporting the seat in a convenient and discrete manner, and they are often inappropriate for use by an adult, given the small size of the aperture in the toddler seat. In addition, carrying a removable toddler-sized toilet seat in public can be an embarrassing task for some caregivers, as well as for the adults in their case.

Thus, there is a particular need for a portable toilet seat which can be placed over an existing toilet seat, which safely and comfortably support a child or physically or mentally challenged adult while using the toilet, and which can be carried by the caregiver in a convenient and discrete manner.

SUMMARY OF THE INVENTION

The present invention is directed towards a portable toilet seat which can be discretely transported, covers the existing toilet's seat, and provides greater support for the person using the toilet, as well as towards a method of using the portable toilet seat for the more efficient and sanitary use of the toilet by an individual. The portable toilet seat has a toilet seat which is mounted inside a container or case, and when enclosed within the container, the outward, overall appearance of the invention is that of a discrete carrying case. These features enable the caregiver to discretely and efficiently transport the seat while in public, and to provide a safer and more sanitary seat for the individual in his or her care.

In one embodiment of the invention, at least part of the container serves as a back rest for the person seated upon the toilet when the portable seat is opened and placed upon the existing toilet. The container has a top and bottom cover or clamshell which pivot upon a flexible spine or hinge or binding to form the back rest for supporting the person using the toilet. When opened, the top cover is held at an approximate right angle to the seat by at least one collapsible or overcenter hinge, and the bottom cover pivots upon the flexible spine until adjacent to the top cover. The top and bottom cover are joined by a clasp which joins the mountable toilet seat to the top cover to form a backrest, which is then held in position by at least one collapsible hinge. This feature provides additional support for the person using the toilet. In one preferred embodiment, a lap belt is mounted to the container, for increasing the support for the person using the toilet, to help the person remain on the seat during toileting.

Optionally, the container has a least one carrying handle or strap mounted on the container for additional ease in transportation, and the container is held shut with a clasp, such as a VELCRO®, hook and loop fasteners fastener, rachet/pawl, or hook pin clasp. The inside surface of the top or bottom of the carrying case may also include pockets to carry items such as premoistened towels, wipes or other cleaning supplies to be used for sanitizing the seat before and after use, as well as for carrying personal hygiene items for cleaning the individual after using the toilet. The toilet seats of the invention may have either adult and child sized toilet seat apertures. Optionally, the toilet seat may also have a urine deflector for preventing urine splashing during use.

The method of operation of the portable toiler seat includes opening the container or case containing the mountable toilet seat, which is pivotally or hingedly mounted within the case, placing the mountable toilet seat upon the existing toilet, sitting upon the portable toilet seat, and using the toilet. The method may also include the step of forming the backrest for providing support while using the toilet. Optionally, the method also includes engaging a belt operably connected to the case around the individual using the toilet to hold the individual to the toilet seat, as well as removing the individual from the toilet seat, and closing the case.

DETAILED DESCRIPTION OF THE INVENTION

Figure 1:
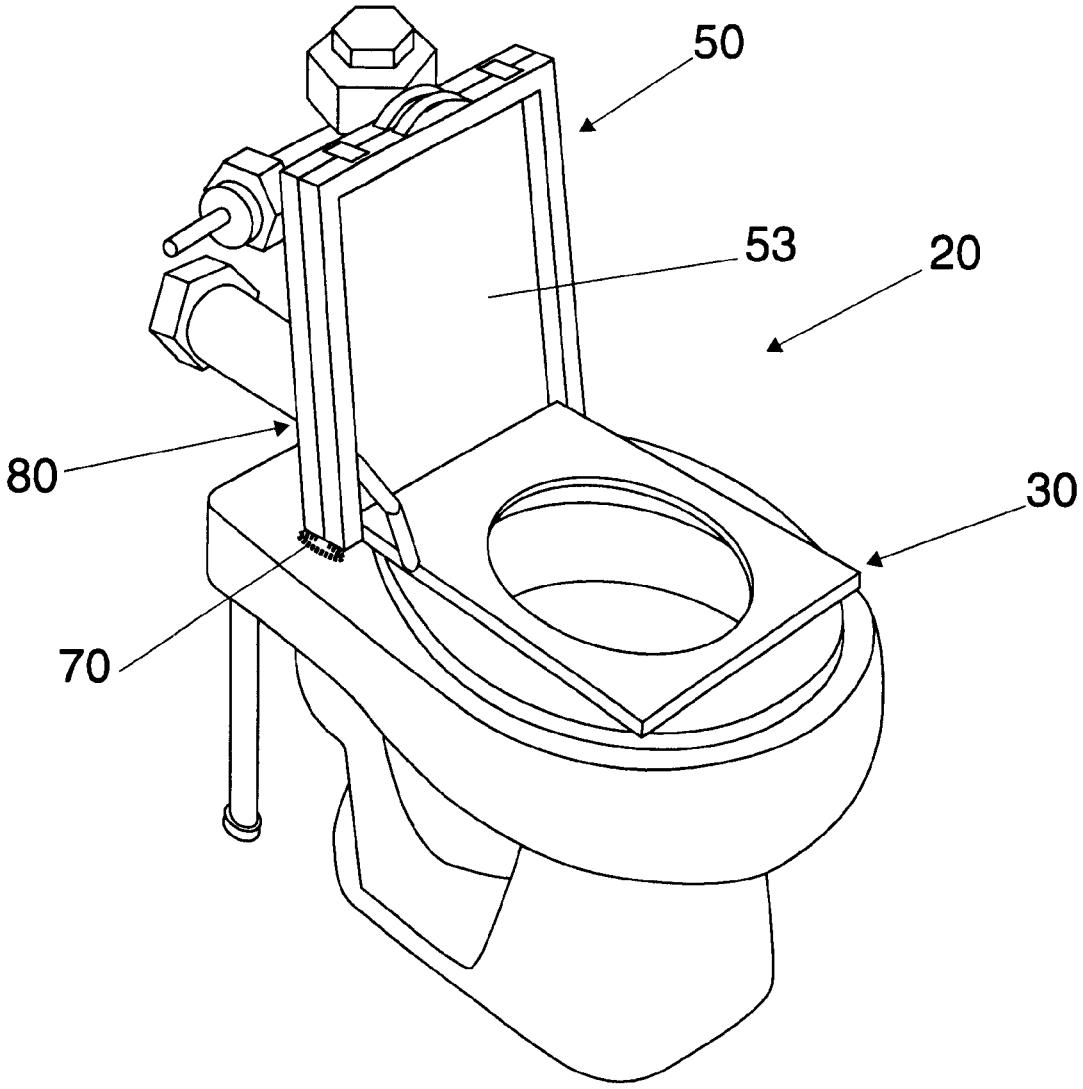
FIG. 1 is a perspective view of one embodiment of the portable seat of the invention placed upon an existing toilet seat.

The present invention relates to a portable toilet seat 20 to be placed over an existing restroom seat prior to using the toilet. FIGS. 1–6 generally depict: a mountable toilet seat 30, a case or container assembly, including a first clamshell cover 50 and a corresponding second clamshell cover 80; and a flexible spine 70 which pivotally joins the first and second clamshell covers 50, 80. As can be best seen in FIG. 2, the main component parts of the portable toilet seat 20 are arranged as follows: the mountable toilet seat 30 is hingedly mounted upon the first clamshell cover 50; the first clamshell cover 50 is mounted to the upper half of the flexible spine 70; and the second clamshell cover 80 is mounted to the lower half of the flexible spine 70.

The portable toilet seat 20 is preferable made from plastic materials so that the portable seat has a washable surface. However, it is contemplated that the invention can be formed from any washable materials ordinarily used in toilet seat and container manufacture. The container or case assembly, as depicted in this embodiment, is a clamshell carrying case, i.e. one that has approximately symmetrical top and bottom covers which are hingedly joined at their back portions. However, it is contemplated that the invention includes other containers which can discretely transport the toilet seat. For example, but without limitation, a lid and box container or a zippered valise may also be used.

Figure 3:
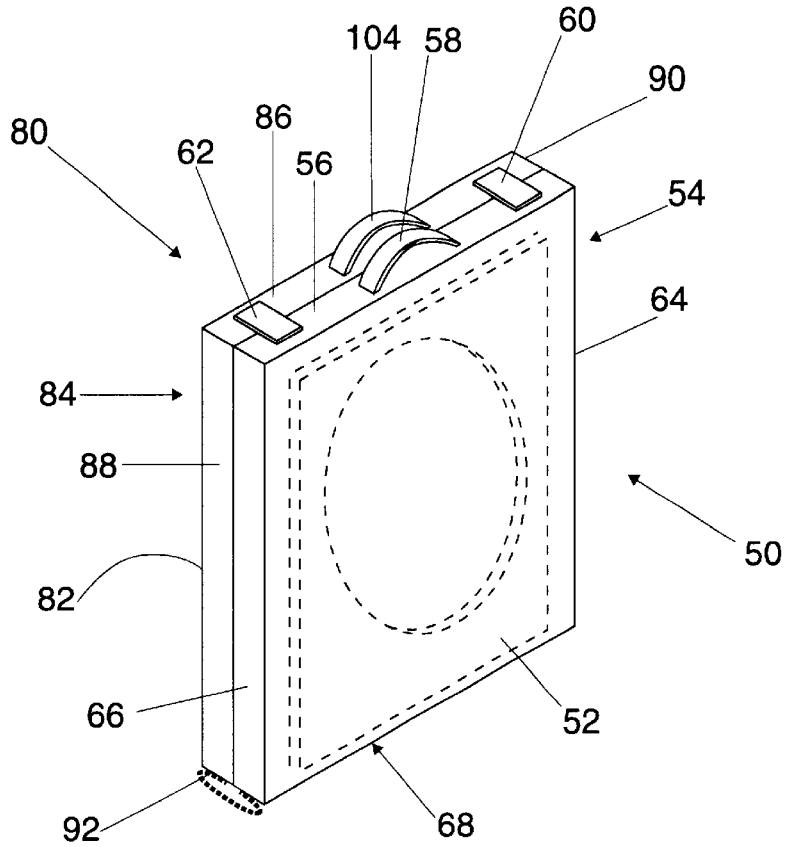
FIG. 3 is a perspective view of the portable toilet seat of FIG. 1 with the container portion closed.

The container assembly as depicted in FIG. 3 includes a first clamshell cover 50, and a second clamshell cover 80. The first clamshell cover 50 includes a top panel 52 and top perimeter walls 54, which depend from and are joined to the edges of the top panel 52. As discussed in detail below, the top panel 52 also includes an interior surface 53, which optionally has interior pockets 98, 100, an interior pouch 102, or elastic straps (See FIGS. 9–11). The top perimeter walls 54 include the top front wall 56, the first and second top side walls, 64, 66 and the top back wall 68. The top panel 52 and perimeter walls 54, are joined at their edges to form an open box shaped, first clamshell cover 50 which partially encloses the mountable toilet seat 30. Although the embodiment depicted has a box shaped container or case, it is contemplated that circular, oval or semi circular top and bottom panels, and corresponding circular, oval or semi-circular depending perimeter wall may also be employed in the first and second clamshell covers, as long as the container discretely encloses the mountable seat 30.

Figure 4:
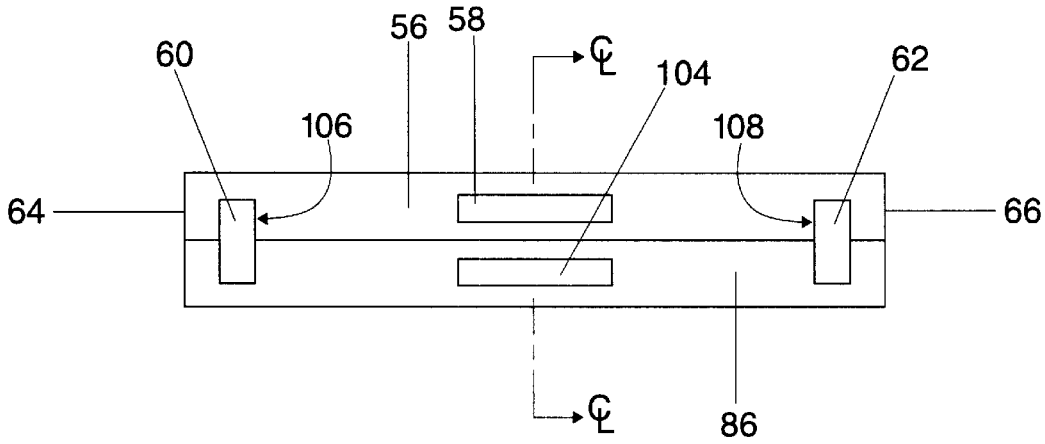
FIG. 4 is a front view of the portable seat of FIG. 1 with the seat closed.

As depicted in FIG. 4, the top front wall 56 has a top carrying handle 58 centrally mounted on the exterior surface of the top front wall 56 between the first and second top side walls 64,66. The top carrying handle 58 on the top front wall 56 is flanked by a first clasp 60 and a second clasp 62 which are pivotally mounted on the outer surface of the top front wall 56. It is recognized that a carrying strap or shoulder strap may be used in addition to or in place of the top carrying handle depicted, and that clasp or hasp mechanisms which can be pivotally mounted may be used in place of the adhering clasps depicted, such as button snaps, rachet/pawl clasps or hook and pin hasps. It is also contemplated that an adjustable lap belt 118 may be operably joined to the top side walls 64, 66, to be placed around the waist while seated on the portable toilet seat. This lap belt would thus provide additional support while using the toilet.

Figure 5:
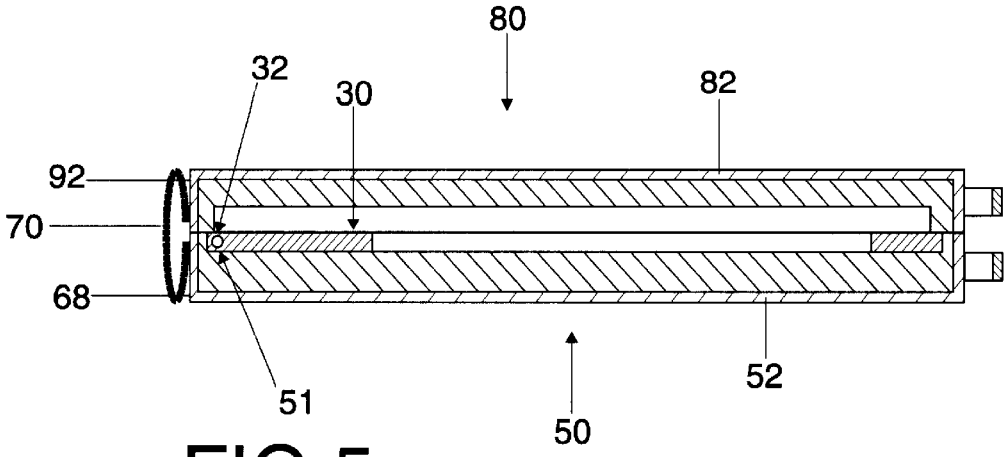
FIG. 5 is a cross-sectional view of the closed portable toilet seat of FIG. 4 taken along line 5—5.

As depicted in FIG. 5, the exterior surface of the top back wall 68 of the first clamshell cover 50 is mounted to the upper portion of the flexible hinge or spine 70. Correspondingly, the exterior surface of the bottom back wall 92 of the second clamshell cover 80 is mounted to the lower portion of the flexible hinge or spine 70. As described below, this feature enables the second clamshell cover 80 to rotate upon the flexible hinge 70 until the top panel 52 and bottom panel 80 abut (See FIG. 6). Although the embodiment depicted has a single flexible spine which substantially covers both exterior surfaces of top back wall 68 and bottom back wall 92, it is contemplated that separate individual hinges may also be spaced along the exterior or interior of the back walls and hingedly join the two clamshell covers. It is recognized that the flexible spine may also be formed from a woven or fibrous material or a flexible sheet of plastic resin, such as polypropylene, polyester or nylon.

Figure 6:
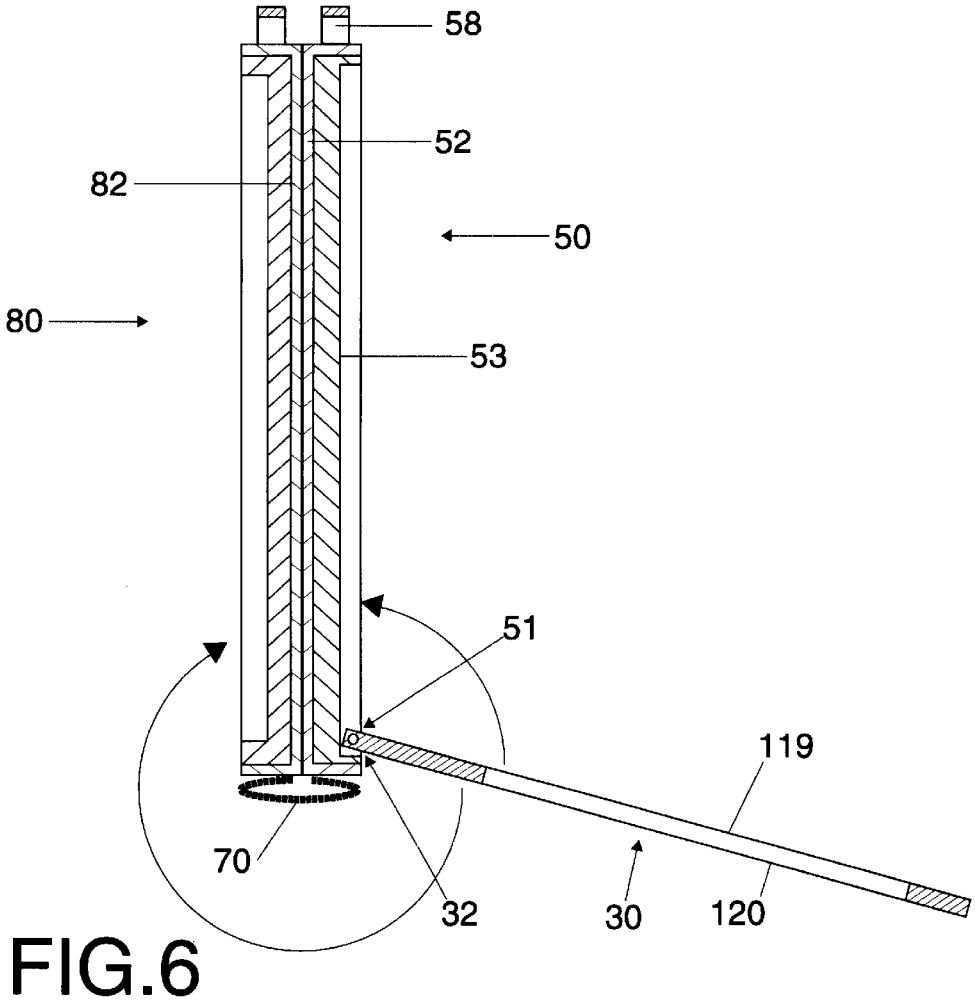
FIG. 6 is a cross-sectional view of FIG. 5 with the toilet seat open.

The second clamshell cover 80 has a bottom panel 82 and bottom perimeter walls 84 joined around the edged of the bottom panel 82 to form an open, box shaped clamshell container. The walls include the bottom front wall 86, the first and second bottom side walls 88, 90, and the bottom back wall 92. As depicted in FIG. 5 and FIG. 6 and described above, the exterior surface of the bottom back wall 92 is mounted to the flexible spine 70. The bottom front wall 86 has a bottom carrying handle 104 centrally mounted on the bottom front wall 86 between the first and second bottom side walls 88, 90. The bottom carrying handle 104 on the bottom front wall 86 is flanked by a first and second bottom clasp receivers 106, 108. As best depicted in FIG. 4, the first and second bottom clasp receivers 106, 108 are mounted upon the exterior of the bottom front wall 86, and are located across from the first and second adhering clasps 60, 62 on the first clamshell cover 50.

Figure 2:
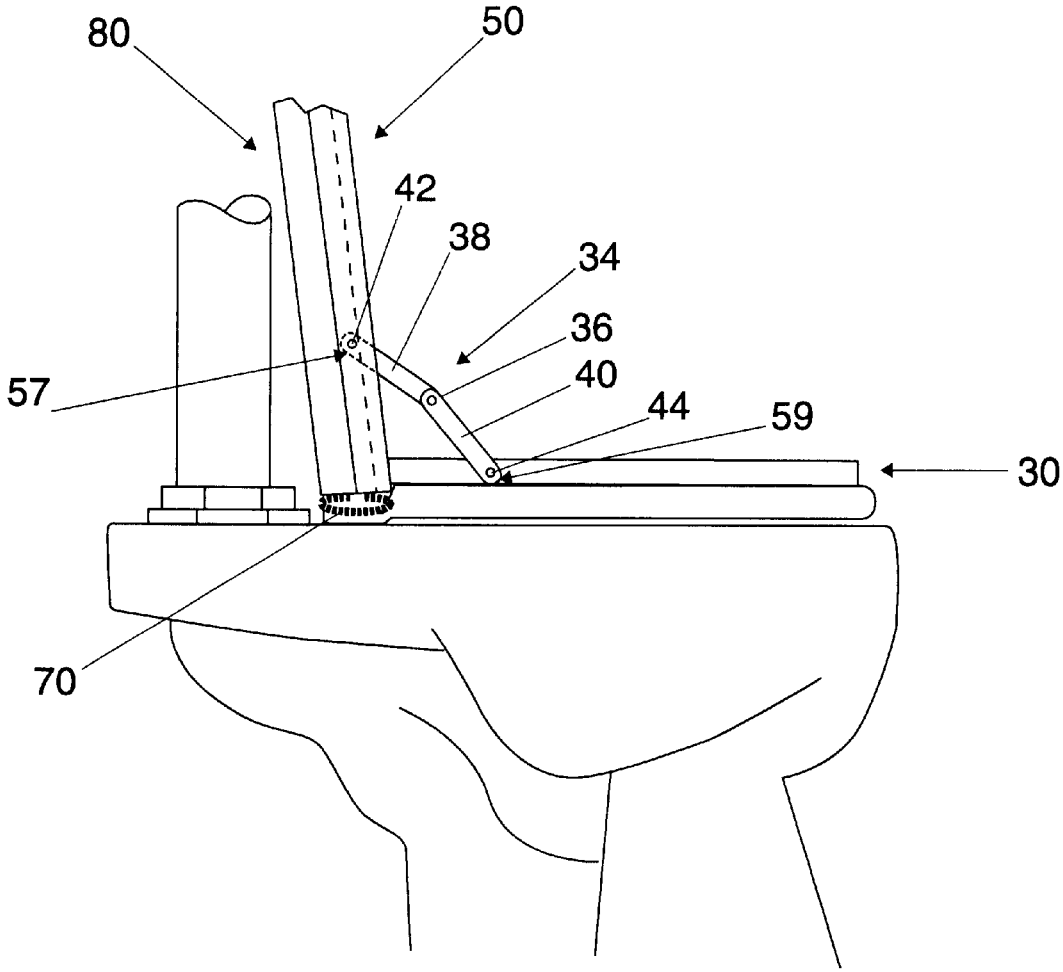
FIG. 2 is a side view of the portable seat of FIG. 1.

As depicted in FIG. 2, the mountable toilet seat 30 and first clamshell cover 50 are also adjustably joined by an overcenter hinge 34. The overcenter hinge 34 has a hinge joint 36 and first and a second post 38, 40. The first post 38 is pivotally joined to the second post 40 to form the hinge joint 36. The opposite end of the first post 38 has a third mounting aperture 42, and the opposite end of the second post 40 has a fourth mounting aperture 44. These third and fourth mounting apertures mount the overcenter hinge 34 to the mountable toilet seat 30 and the first clamshell cover 50. Second top side wall, 66, of the first clamshell cover 50 has a first overcenter hinge mounting pin 57 located on the interior surface of the first side walls 64. The first overcenter hinge mounting pin 57 on the first clamshell cover 50 extends through the third mounting aperture 42 on the first post 38 to pivotally mount the overcenter hinge 34 to the first clamshell cover 50.

The second overcenter hinge mounting pin 59 is located on the outer rim of exterior surface of the toilet seat 30, and extends through the fourth mounting aperture 44 to adjustably join the mountable toilet seat 30 to the overcenter hinge 34. Thus, the mountable toilet seat and the first clamshell cover are pivotally joined by hinges at the back of the seat and cover, and by an overcenter hinge pivotally joining the side wall to the side of the toilet seat.

Figure 7:
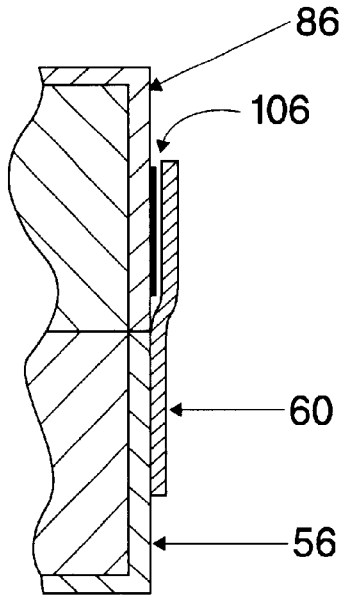
FIG. 7 is a fragmented cross-sectional view of the portable toilet seat of FIG. 4 taken along line 7—7.

As depicted in FIG. 4 and FIG. 7, when the container is closed and encompasses the mountable seat for transportation, the first clasp 60 on the top front wall 56 engages the corresponding first clasp receiver 106 on the bottom front wall 86, and the second clasp 62 on the top front wall 56 engages to the corresponding second clasp receiver 108 on the bottom front wall 86, thereby releaseably closing the container.

The clasps and clasp receivers depicted herein are corresponding long straps 60, 62 and short patches 106,108 with corresponding Velcro® hook and loop fasteners the container assembly closed when the clasp and clasp receiver are affixed to each other. The clasps 60,62 also pivot 180 degrees, to releasably affix the bottom cover to the top cover to form the backrest. As depicted in FIG. 6, when open and configured to place upon the existing toilet seat, the bottom panel 82 of the second clamshell cover 80 abuts the top panel 52 of the first clamshell cover 50. The first and second clasps 60, 62 are pivoted 180 degrees and adhered to the first and second adhering velcro clasp receivers 106–108, thus releasably joining the clamshell covers to form the backrest to provide support for the toilet seat's user. However, it is recognized that other pivotally mountable clasp mechanism may also be used, and that separate clasp mechanisms may also be used respectively to hold the container closed and form the backrest. For example, but without limitation, a hook and hasp, a releaseable rachet and pawl, or corresponding male and female button snaps may also be used.

Figure 8:
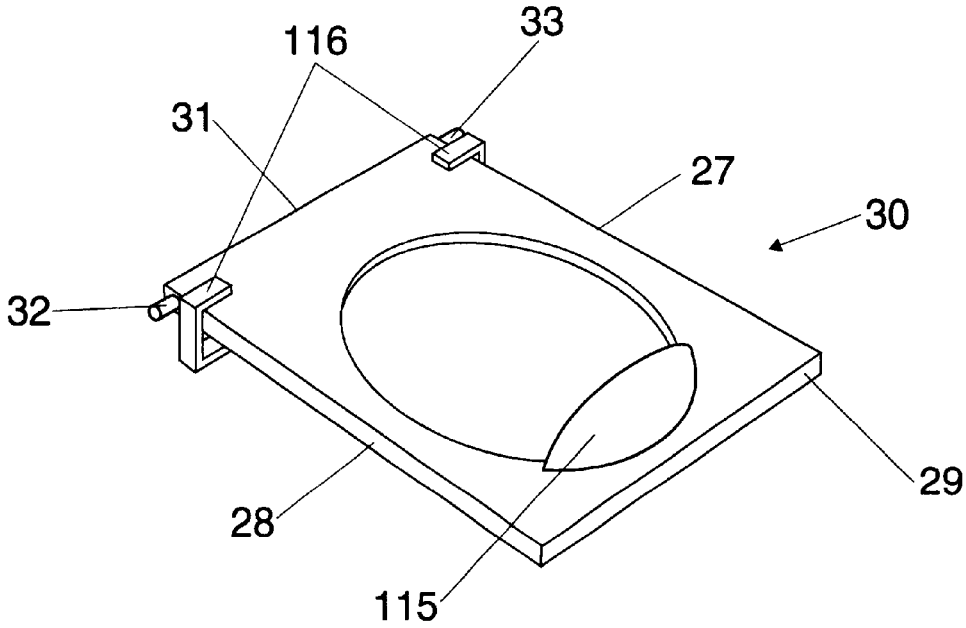
FIG. 8 is an perspective view of the portable seat of FIG. 1 disassembled from the container.

As depicted in FIGS. 8–11, the mountable toilet seat 30 is pivotally mounted to the first clamshell cover. The first and second top side walls 64, 66 of the first clamshell cover have a first mounting aperture 51 and a second mounting aperture (not shown) located directly across from and facing one another on the interior of the side walls 64, 66, approximately adjacent to the top back wall 68. As best seen in FIG. 8, the mountable toilet seat 30 superior surface 19 inferior surface 120 has a front 29, a back 31, and a first and second side portion 27, 28, as well as first and second hinge pins 32, 33, corresponding to the first and second mounting apertures 51, (not shown). These hinge pins 32, 33 are located on the side portions 27, 28 adjacent to the back 31 of the mountable toilet seat 30, and extend through the first and second mounting apertures 51, (not shown) and pivotally join the mountable seat 30 to the first clamshell cover 50.

As depicted in FIG. 8, although the mountable toilet seat 30, is a unitary flat seat, it is recognized that additional shapes and structures may also be employed. For example, a urine splash guard 115 may be mounted to the front of the seat, which is shaped as semi-spherical dome and mounted to the front of said toilet seat, a round or oval shaped seat may be used, the seat's aperture may be reduced in size or width to provide more effective support for toddler age children for example, in the size range of about 30 to 40 inches or about 20 to 40 pounds, or a clip 116 or friction surface may be placed upon the seat for increased stability relative to the existing toilet seat.

Figure 9:
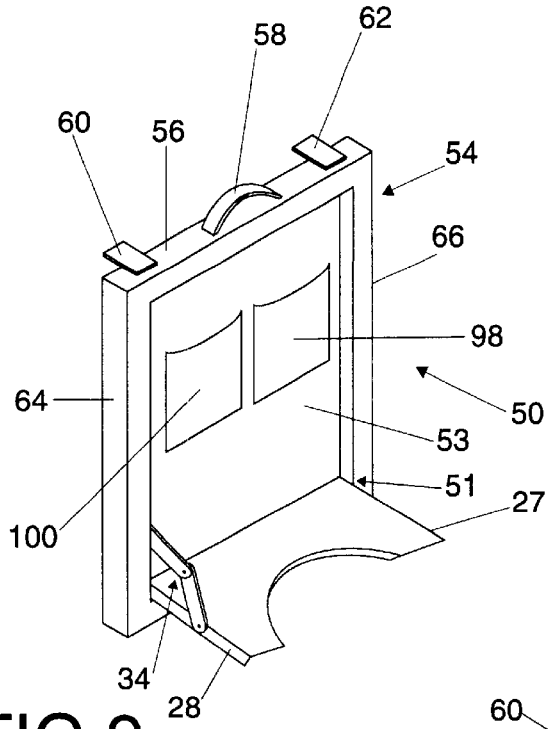
FIG. 9 is a perspective view one embodiment of the portable toilet seat of the invention showing a pair of pockets on the top cover's interior surface.
Figure 10:
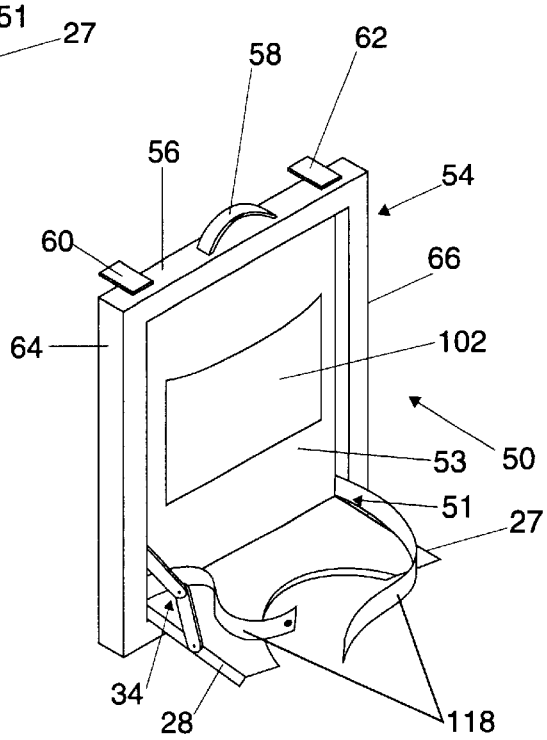
FIG. 10 is a perspective view of another embodiment of the portable seat of the invention showing one large pocket on the top cover's interior surface.
Figure 11:
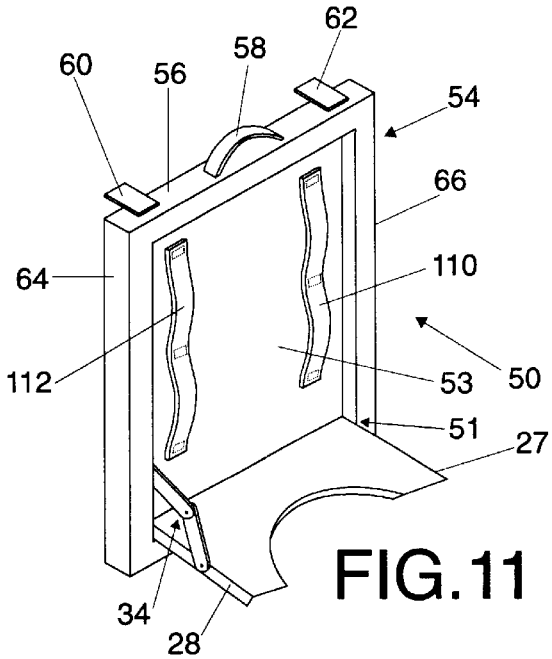
FIG. 11 is a perspective view of the another embodiment of the portable toilet seat of the invention showing straps for holding containers, such as containers of cleaning solution or disinfectant spray.

As depicted in FIG. 9, the first and second interior pockets 98, 100 are mounted 20 to the interior surface 53 of the top panel 52 of the first clamshell cover, and can be used to transport and store cleaning supplies to clean the individual using the toilet or the portable toilet seat itself. FIG. 10 depicts an embodiment of the interior surface 53 of top panel 52, with a single pouch 102, while FIG. 11 depicts another embodiment having first and second elastic straps 110, 112 placed near the first and second top side walls 64, 66. These straps may be used to hold canisters of disinfectant, topical analgesics or other items useful in the care of incontinent or semi-incontinent individuals, and it is recognized that pockets, pouch or straps may also be located on the interior surface of the bottom cover.

It is also recognized that changes or modifications may be made to the embodiments depicted and described herein without departing from the scope of the invention. Therefore, it is intended that the foregoing drawings and description shall be interpreted as an illustration of the invention and not as limitations upon the invention. The only limitations intended and contemplated to be upon the invention are those found in the claims below.

What is claimed:

1. A portable toilet seat for use with an existing toilet, comprising:

a toilet seat for covering the existing toilet, and a container for transporting the toilet seat, said toilet seat mounted within said container.

2. The portable toilet seat of claim 1, further comprising at least one hinge for pivotally mounting the container to the seat.

3. The portable toilet seat of claim 1, wherein said container is a clamshell case.

4. The portable toilet seat of claim 3, wherein said clamshell case includes a first cover for enclosing the toilet seat, a second cover for enclosing seat, and a flexible spine, said flexible spine pivotally joining said first and second covers.

5. The portable toilet seat of claim 3, her comprising a backrest for supporting the person using the toilet, said backrest pivotally mounted to said toilet seat.

6. The portable toilet seat of claim 4, further comprising a backrest for supporting the person using the toilet, wherein said backrest is formed by said first and second covers.

7. The portable toilet seat of claim 1, farther comprising at least one hinge for opening and holding the cover upright from the toilet seat, said hinge pivotally connecting said container to said toilet seat.

8. The portable toilet seat of claim 4, further comprising at least one clasp for releaseably attaching the first and the second covers, said clasp operably and pivotally mounted to said container.

9. The portable toilet seat of claim 6, further comprising at least one clasp for forming the backrest, said clasp pivotally and operably mounted to said clamshell cover.

10. A portable toilet seat for covering an existing toilet, comprising:

a first container portion for enclosing the toilet seat, said first container portion including a first cover for enclosing the toilet seat, at least one clasp, said clasp operably mounted to the front exterior of said first cover;

a flexible spine, said flexible spine mounted to said first container portion;

a second container portion for enclosing the toilet seat, said second container portion including a second cover for enclosing the toilet seat, said second cover mounted to the flexible spine to pivotally mount the first and second container portions;

a toilet seat to be placed over the existing toilet, said toilet seat having a front portion, a superior and inferior surface, a central aperture, and a back portion, said toilet seat pivotally mounted to the first container portion.

11. The portable toilet seat of claim 10, further comprising at least one collapsible hinge for fixing the first container portion at an approximate right angle to said seat, said at least one collapsible hinge adjustably joining said first container portion to said toilet seat.

12. The portable toilet seat of claim 10, further comprising at least one overcenter hinge for fixing the first container portion at an approximate right angle to the seat, said overcenter hinge having a hinge joint, a first post depending from said joint and mounted to said toilet seat, and a second post depending from said joint and mounted to said first container portion.

13. The portable toilet seat of claim 10, further comprising at least one clip for mounting said toilet seat to the restroom seat, said clip fixedly mounted on said toilet seat.

14. The portable toilet seat of claim 13, further comprising at least one pouch, said at least one pouch operably affixed to the interior surface of the first container portion or the interior surface of the second container portion.

15. The portable toilet seat of claim 10, further comprising a lap belt for releaseably holding the individual to the toilet seat, said lap belt operably and adjustably affixed to the first container portion.

16. The portable-toilet seat of claim 10, further comprising at least one pocket, said pockets mounted to the first or second container.

17. The portable toilet seat of claim 10, further comprising a urine deflector for preventing urine splashing during use.

18. The portable toilet seat of claim 10, further comprising at least one carrying handle, said carrying handle mounted to the front exterior surface of the first or second container portion.

19. The portable toilet seat of claim 10, wherein the toilet seat aperture is sized for use by a child.

* * * * *